United States Patent [19]

Rogos

[11] 4,307,877

[45] Dec. 29, 1981

[54] TRANSMISSION FIXTURE

[76] Inventor: Donald D. Rogos, R.D. #2, Brockway, Pa. 15824

[21] Appl. No.: 118,075

[22] Filed: Jan. 31, 1980

[51] Int. Cl.[3] ..... B25B 1/22

[52] U.S. Cl. ..... 269/46; 269/15; 269/17; 269/47; 269/71; 269/296; 269/130

[58] Field of Search ..... 269/15, 17, 46, 79, 269/55, 71, 47, 296, 130; 254/133, 134

[56] References Cited

U.S. PATENT DOCUMENTS

| | | | |
|---|---|---|---|
| 1,481,503 | 1/1924 | Carswell et al. | 269/17 X |
| 2,301,019 | 11/1942 | Couse | 269/17 |
| 2,748,459 | 6/1956 | Orr | 254/134 |
| 2,931,644 | 4/1960 | Kenworthy | 269/17 |
| 3,559,981 | 2/1971 | Abshear | 254/134 X |
| 4,010,942 | 3/1977 | Ward | 269/17 X |

*Primary Examiner*—Robert C. Watson
*Attorney, Agent, or Firm*—Harvey B. Jacobson

[57] ABSTRACT

A rigid elongated framework contains a traverse mounting member at one end for attachment to the bell housing of the transmission. A belt is wrapped around the opposite end of the framework and transmission to pull the transmission toward the framework. A central extendible support member is moved into engagement with the center of the transmission body to insure secure engagement between the transmission and the framework. The framework and transmission can be moved to several positions for providing easy access to any part of the transmission. A second embodiment is also provided which includes an upright framework with a pivotable transmission mounting structure.

9 Claims, 6 Drawing Figures

TRANSMISSION FIXTURE

BACKGROUND OF THE INVENTION

1. Field of the Invention

This invention relates to support stands and especially to support stands adapted for supporting a transmission to be overhauled or repaired.

2. Discussion of Related Art

In the maintenance and repair of automatic transmissions, it is usually necessary to remove the transmission from the vehicle and dismantle it in order to adequately inspect all of the components thereof. Automatic transmissions are generally heavy, bulky objects which are not easy to handle or move. Furthermore, it is preferable that certain areas of the transmission are not forced to carry substantial weight due to their fragile nature. Therefore, it is desirable to have a support stand which can allow a transmission to be easily and quickly maneuvered but supports the transmission in such a way as to insure no harm will come to it.

Various mounts have been suggested for automotive parts. For instance, U.S. Pat. No. 4,010,942, issued Mar. 8, 1977 to Ward, shows a support assembly for automotive transmissions, which support includes first and second portions that may be separated and in combination with an overhead hoist permits a transmission after being removed from a vehicle to be raised and moved to a desired location where fluid may be drained from the transmission. The Ward device includes an inverted U-shaped member having first and second free end portions with the first end portion having a bar extending outwardly therefrom and the first end also including a first threaded pin that extends toward a second pin. The second threaded pin is supported from a second end of the member and is in coaxial alignment with the first pin. A handle is provided for rotating the second pin.

SUMMARY OF THE INVENTION

One object of the present invention is to provide a transmission fixture which allows one man to overhaul a complete transmission while it is sitting on the floor.

A further object of the present invention is to provide a transmission fixture which provides easy mobility to the transmission attached thereto.

An even still further object of the present invention is to provide a transmission fixture having a bell housing anchor which relieves pressure on critical areas of the transmission body to reduce the possibility of distortion or fracture of the body.

One additional still further object of the present invention is to provide a transmission fixture which can easily be attached to a transmission while the transmission is lying on the floor.

Another additional object of the present invention is to provide a transmission fixture which can be used with a large variety of automatic transmissions.

Another object of the present invention is to provide a transmission fixture which includes a pan for catching transmission fluid as it is drained from the transmission.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
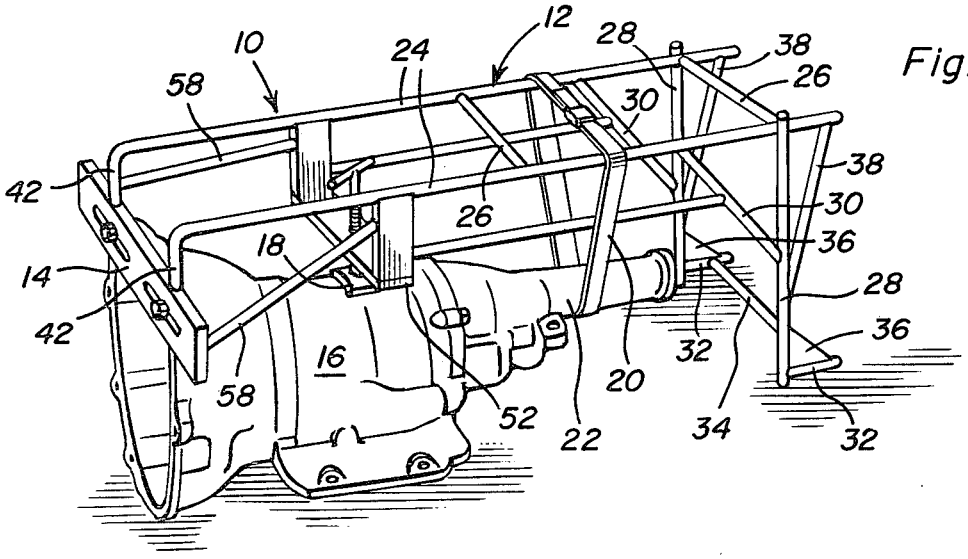
FIG. 1 is a perspective view of the transmission fixture mounted on a transmission.
Figure 2:
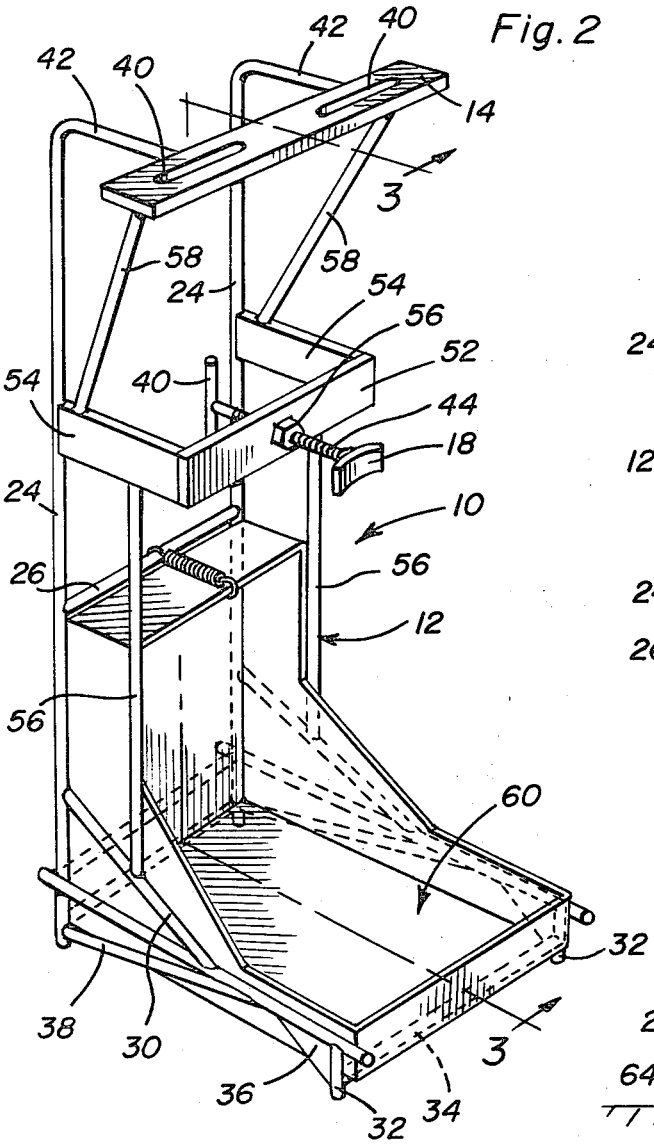
FIG. 2 is a perspective view of the transmission fixture in an upright position.
Figure 3:
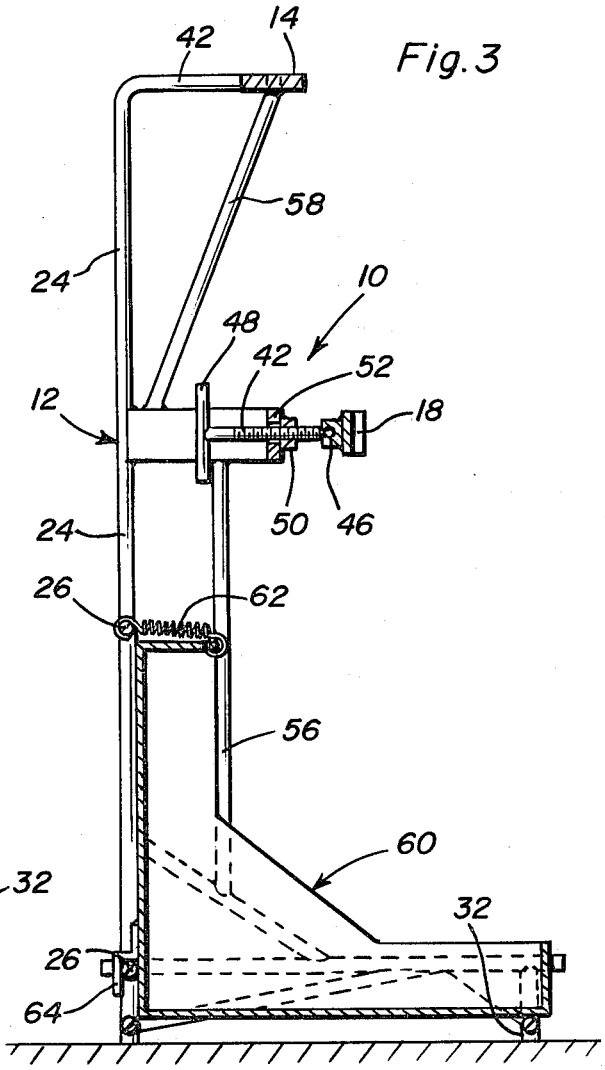
FIG. 3 is an elevational sectional view taken substantially along a plane passing through section line 3—3 of FIG. 2.

Now with reference to the drawings, a transmission fixture incorporating the principles and concepts of the present invention and generally referred to by the reference numeral 10 will be described in detail. With particular reference to FIGS. 1–3, it will be seen that transmission fixture 10 includes an elongated framework 12 which comprises bell housing mounting bar 14 which attaches to the bell housing of a transmission 16 and central support member 18 which engages the central portion of the housing of transmission 16. A strap 20 surrounds the tailpiece 22 and the framework 12 to hold the central portion of transmission 16 against central support 18. With the transmission thus firmly in place, the transmission fixture 10 and transmission 16 can be moved easily about as an integral unit.

The framework 12 is formed as a cage-like structure for both supporting and protecting the transmission 16. The framework includes a pair of parallel longitudinal members 24 which are spaced laterally by a distance which is greater than the width of a transmission to be mounted in the fixture. Transverse support members 26 extend between and connect longitudinal members 24 to lend support to the fixture. A pair of laterally extending members 28 are connected respectively to the longitudinal members 24 at positions spaced from the ends of the members 24. The members 28 have a length which is slightly greater than the normal width of transmission 16 and serve to support the fixture 10 when it and an attached transmission lie in a horizontal position as shown in FIG. 1. A pair of braces 30 extend between associated longitudinal members 24 and lateral members 28 to lend rigidity to the connection between the members. Attached to the distal end of each member 28 is a small leg 32 which has a length equal to the distance the member 28 is spaced from the end of its associated member 24. Legs 32 are connected by an additional transverse member 34 which extends between the ends of the legs. Accordingly, when the fixture is disposed in an upright position, as shown in FIGS. 2 and 3, legs 32 together with the ends of longitudinal members 24 serve to support the fixture 10 with or without a transmission mounted therein. Gusset plates 36 are mounted between each leg 32 and its associated lateral member 28 to rigidify the leg. Similarly, braces 38 extend between the extreme ends of longitudinal members 24 and the associated lateral members 28 to provide rigidity thereto.

At the opposite end of the frame, the bell housing mount 14, which comprises a flat bar having two longitudinal slots 40 formed therein, is mounted on the ends of longitudinal members 24 which are bent to extend parallel to lateral members 28. The bent ends 42 of the longitudinal members 24 extend only partially the distance extended by the lateral members 28. In actual practice, members 28 are approximately 18-½ inches in length and ends 42 extend approximately 4-¼ inches with bell housing mount 14 being 2 inches in width thereby positioning slots 40 approximately 5-½ inches from the longitudinal members 24. Members 24 are approximately 10-½ inches apart and bell housing mount 14 is approximately 19-½ inches in length.

The central support 18 comprises an arcuate plate mounted on a threaded shaft 44 by use of a ball and socket connection 46. Accordingly, the threaded shaft can be turned via handle 48 to adjust the amount of extension from nut 50 to control pressure of the central support 18 on the transmission body. Nut 50 is mounted on a transverse bar 52 which in turn is mounted on a pair of laterally extending bars 54. Longitudinal support members 56 extend from bars 54 to support member 30 while braces 58 extend from bars 54 to bell housing mount 14.

Optionally, a drip pan 60, made from sheet metal can be formed with an overall L shape to fit snugly within the area defined by members 28, transverse member 34 and longitudinal members 24. A spring 62 extends from the edge of the pan to one transverse support member 26 to hold the pan in place. A pair of offset clips, one of which is shown at 64 in FIG. 3, extend rearwardly of pan 60 and engage the other lateral support member 26 to hold the bottom of the pan in place. Accordingly, the pan can easily be inserted or removed from the confines of frame 12 to catch drippings from the transmission 16 in the form of transmission fluid.

In use, the bell housing of the transmission is bolted to bell housing mount 14 as shown in FIG. 1 and the strap 20 is disposed about the tailpiece of the transmission and the frame. Central support 18 is then extended to engage the center of the transmission body and sufficient force is applied to hold the transmission rigidly in place by forcing the tailpiece outwardly against strap 20. The fixture and transmission can then be moved as a unitary structure with the weight of the transmission being taken by the bell housing and members 28 when in the horizontal position as shown in FIG. 1 or by longitudinal members 24 and legs 32 when in the vertical position as shown in FIGS. 2 and 3. The orientation of the transmission can easily be changed to allow access to various points on the transmission to be worked on.

Figure 4:
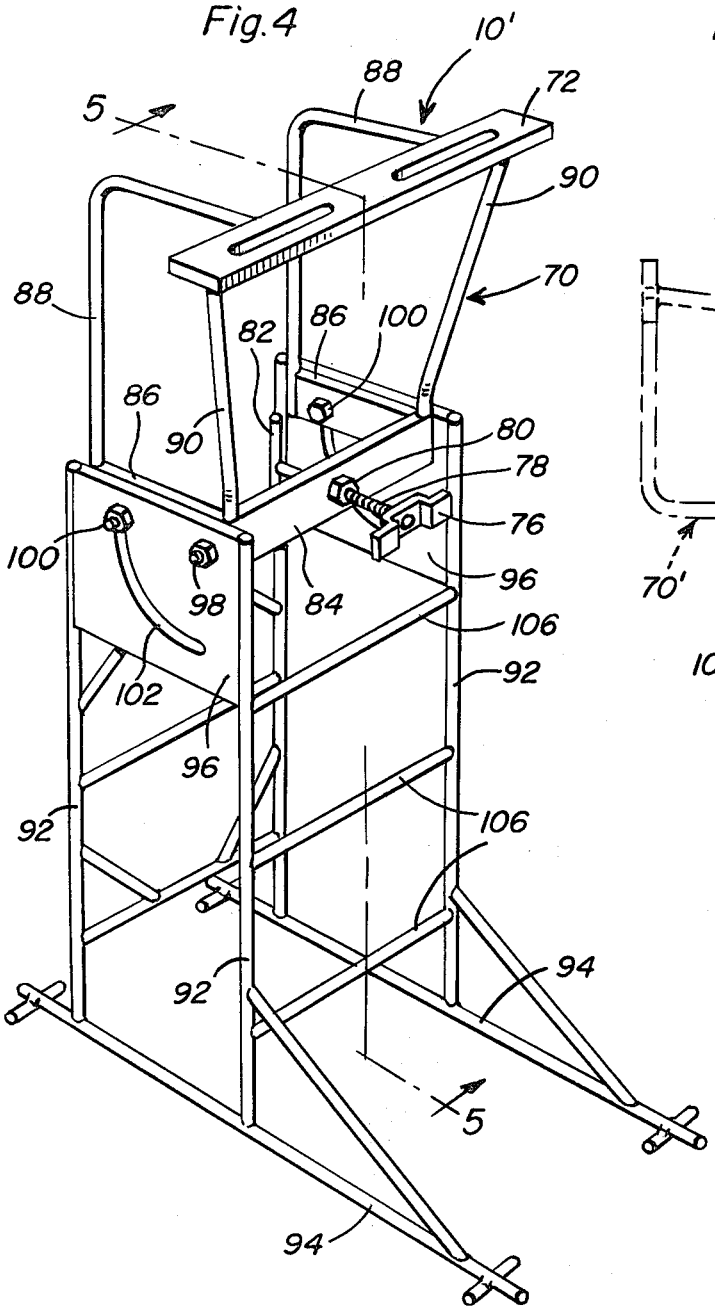
FIG. 4 is a perspective view of a second embodiment of the transmission fixture disposed in an upright position.
Figure 5:
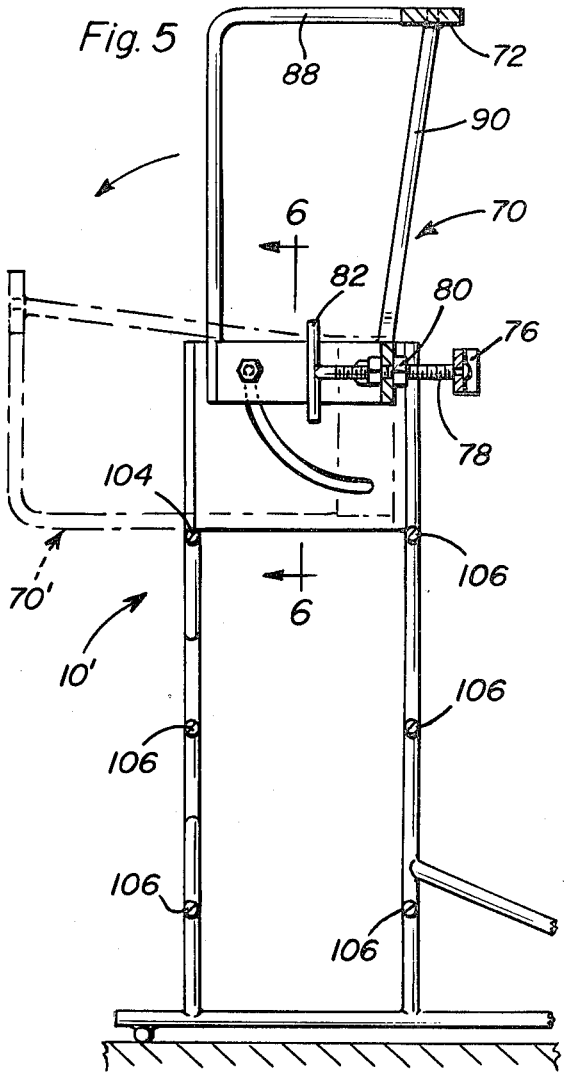
FIG. 5 is an elevational sectional view taken substantially along a plane passing through section line 5—5 of FIG. 4.
Figure 6:
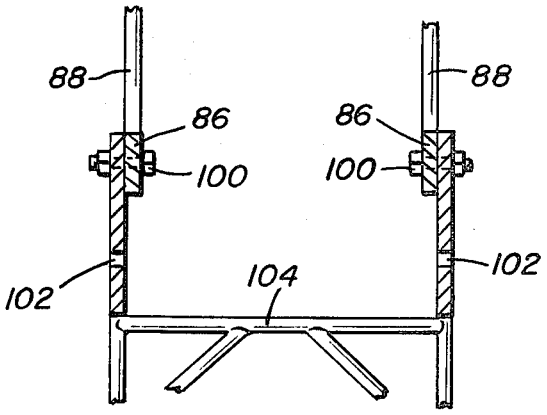
FIG. 6 is a front elevational sectional view taken substantially along a plane passing through section line 6—6 of FIG. 5.

FIGS. 4–6 show a second embodiment of the transmission fixture generally labelled with the reference numeral 10'. Fixture 10' allows additional versatility in that the transmission can be tilted with the fixture in its vertical position by use of upper transmission mount structure 70. Mount structure 70 includes a bell housing mounting bar 72 and a central support 76. Support 76 is pivotally connected to a threaded shaft 78 which extends to nut 80 and can be turned by use of handle 82. Nut 80 is mounted on a transverse bar 84 which engages two support bars 86. Support bars 86 mount normally bent support members 88 which extend from the bars 86 to the bell housing mount 72. Additional support members 90 extend from opposite ends of bar 84 to bell housing mount 72.

The lower portion of fixture 10' includes four uprights 92 which are mounted in pairs to legs 94. Each pair of uprights is connected by a plate 96. Plates 96 pivotally mount the transverse bar 84 at the ends of the bar by use of studs one of which is shown at 98 passing through a plate 96. Each plate 86 includes a bolt 100 passing therethrough which bolts also pass through arcuate slots 102 formed in plates 96 to allow bars 86 to pivot through a 90° arc. A lateral support bar 104 extends between the rearmost uprights 92 and is positioned to aid in the support of upper transmission mount structure 70 when it is positioned in its most angled position as shown in FIG. 5 at 70'. Additional lateral supports 106 are connected between uprights 92 to provide rigidity to the support structure. Other braces are also included for rigidity as would be apparent to one of ordinary skill in the art.

In operation, it can be seen that the upper transmission mount structure 70 can be placed in its aligned position with the lower support structure as shown in FIG. 4 and used in a manner similar to fixture 10 by including a belt about the uprights 92. When the transmission and fixture 10' are placed in a vertical position, the belt can be removed and the angle of the transmission adjusted through use of bolts 100 disposed in slots 102.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A holding fixture for an elongated transmission housing having opposite axial ends, comprising a rigid framework adapted to be displaced between horizontal and vertical positions relative to a floor surface, releasable means mounted on the framework for mounting the transmission housing on the framework, and base means rigidly secured to the framework and displaceable therewith for contact with the floor surface in the horizontal and vertical positions to respectively support the framework in the vertical position and spaced above the transmission housing in the horizontal position, said releasable means including a bar in axial abutment with one of the axial ends of the transmission housing.

2. The combination of claim 1 wherein said one of the axial ends of the transmission housing constitutes an end flange of a bell formation, the other of the axial ends forming part of a tail piece portion of the housing.

3. The combination of claim 2 wherein said releasable means further includes extensible means spacing the framework from the transmission housing intermediate said opposite axial ends and flexible means suspending the tail piece portion from the framework in the horizontal position.

4. The combination of claim 3 including angularly adjustable means pivotally mounting the bar on the framework for support of the transmission housing thereon in an angularly adjusted position.

5. A holding fixture for an elongated transmission housing having opposite axial ends, comprising a rigid framework adapted to be displaced between horizontal and vertical positions relative to a floor surface, releasable means mounted on the framework for mounting the transmission housing on the framework, and base means rigidly secured to the framework and displaceable therewith for contact with the floor surface in the horizontal and vertical positions to respectively support the framework in the vertical position and spaced above the transmission housing in the horizontal position, said releasable means including axial abutment means engageable with the transmission housing at one of the axial ends thereof, extensible spacing means engageable with the housing intermediate said axial ends, and flexible suspending means engageable with the housing adjacent the other of the axial ends.

6. The combination of claim 1 including angularly adjustable means pivotally mounting the bar on the framework for support of the transmission housing thereon in an angularly adjusted position.

7. a holding fixture for an elongated transmission housing having opposite axial ends, comprising a rigid framework adapted to be displaced between horizontal and vertical positions relative to a floor surface, releasable means mounted on the framework for mounting the transmission housing on the framework, base means rigidly secured to the framework and displaceable therewith for contact with the floor surface in the horizontal and vertical positions to respectively support the framework in the vertical position and spaced above the transmission housing in the horizontal position and means mounting the releasable means on the framework for angularly adjusting the transmission housing while supported on the framework in the vertical position thereof.

8. A holding fixture for an elongated transmission housing having opposite axial ends, comprising a rigid framework adapted to be displaced between horizontal and vertical positions relative to a floor surface, releasable means mounted on the framework for mounting the transmission housing on the framework, base means secured to the framework for support of the transmission housing in said vertical and horizontal positions of the framework, and means mounting the releasable means on the framework for angularly adjusting the transmission housing while supported on the framework in the vertical position thereof.

9. A holding fixture for an elongated transmission housing having opposite axial ends, comprising a rigid framework adapted to be displaced between horizontal and vertical positions relative to a floor surface, releasable means mounted on the framework for mounting the transmission housing on the framework, and base means secured to the framework for support of the transmission housing in said vertical and horizontal positions of the framework, said releasable means including axial abutment means engageable with the transmission housing at one of the axial ends thereof, extensible spacing means engageable with the housing intermediate said axial ends, and flexible suspending means engageable with the housing adjacent the other of the axial ends.

* * * * *